US010421175B2

(12) United States Patent
Chou

(10) Patent No.: US 10,421,175 B2
(45) Date of Patent: Sep. 24, 2019

(54) ANTI-THEFT RACK FOR SOCKET TOOLS

(71) Applicant: RE-DAI PRECISION TOOLS CO., LTD., Taichung (TW)

(72) Inventor: Yi-Chiu Chou, Taichung (TW)

(73) Assignee: Re-Dai Precision Tools Co., Ltd., Taichung (TW)

( * ) Notice: Subject to any disclaimer, the term of this patent is extended or adjusted under 35 U.S.C. 154(b) by 0 days.

(21) Appl. No.: 15/982,039

(22) Filed: May 17, 2018

(65) Prior Publication Data

US 2019/0091842 A1 Mar. 28, 2019

(30) Foreign Application Priority Data

Sep. 28, 2017 (TW) ..... 106133423 A

(51) Int. Cl.

| | |
|---|---|
| ***B25B 23/00*** | (2006.01) |
| ***B25B 13/06*** | (2006.01) |
| ***B25B 13/56*** | (2006.01) |
| ***B25H 3/04*** | (2006.01) |

(52) U.S. Cl.

CPC ..... *B25B 23/0035* (2013.01); *B25B 13/06* (2013.01); *B25B 13/56* (2013.01); *B25H 3/04* (2013.01)

(58) Field of Classification Search

CPC ..... B25H 3/04; B25H 3/06; B25B 23/0035; B25B 13/06; B25B 13/56

See application file for complete search history.

(56) References Cited

U.S. PATENT DOCUMENTS 5,228,570 A * 7/1993 Robinson ..... B25H 3/06 206/375
5,467,874 A * 11/1995 Whitaker ..... B25B 23/0035 206/378
6,092,655 A * 7/2000 Ernst ..... B25H 3/06 206/378
6,092,656 A * 7/2000 Ernst ..... B25H 3/06 206/378
6,386,363 B1 * 5/2002 Huang ..... B25H 3/003 206/1.5

(Continued)

FOREIGN PATENT DOCUMENTS

DE 202016105073 U1 * 11/2016 ..... B25H 3/04
TW I572466 B 3/2017

*Primary Examiner* — Stanton L Krycinski
(74) *Attorney, Agent, or Firm* — Alan D. Kamrath; Mayer & Williams PC

(57) ABSTRACT

An anti-theft rack includes a rack frame supporting at least one retaining device. The at least one retaining device is configured to retain a socket tool and includes a seat mounted on the rack frame, a sliding member slidably engaged with the seat, and a retaining member disposed between the seat and the sliding member. The seat includes a shaft portion and the sliding member is movably mounted on the shaft portion. The shaft portion includes a first recessed portion and a second recessed portion of different depths adapted to receive the retaining member. The retaining member is selectively disposed in the first and second recessed portions in response to movement of the sliding member. Further, a position limiter is releasably disposed between two terminal positions of a moving path of the sliding member and configured to prevent the sliding member from the first position to the second position.

18 Claims, 8 Drawing Sheets

(56) References Cited

U.S. PATENT DOCUMENTS

| | | | | |
|---|---|---|---|---|
| 6,488,151 | B2 * | 12/2002 | Ramsey | B25H 3/06 206/378 |
| 6,575,312 | B2 * | 6/2003 | Santa Cruz | A47F 7/0028 211/70.6 |
| 6,698,600 | B1 * | 3/2004 | Lee | B25H 3/003 206/378 |
| 6,712,225 | B2 * | 3/2004 | McNeely | B25H 3/003 206/378 |
| 6,991,105 | B2 * | 1/2006 | Winnard | B25H 3/003 206/378 |
| 7,137,514 | B1 * | 11/2006 | Nickipuck | B25H 3/04 211/70.6 |
| 7,841,480 | B2 * | 11/2010 | Hsieh | B25H 3/06 206/378 |
| 8,152,003 | B1 * | 4/2012 | Kao | B25H 3/04 211/70.6 |
| 8,499,935 | B2 * | 8/2013 | Hsieh | B25H 3/04 206/349 |
| 8,770,418 | B2 * | 7/2014 | Ernst | B25H 3/04 211/70.6 |
| 9,247,832 | B2 * | 2/2016 | Chang | A47F 5/0823 |
| 9,375,836 | B2 * | 6/2016 | Su | B25H 3/04 |
| 9,527,206 | B1 * | 12/2016 | Hsieh | B25H 3/003 |
| 9,782,890 | B2 * | 10/2017 | Hsieh | B25H 3/04 |
| 9,914,207 | B2 * | 3/2018 | Kao | B25H 3/04 |
| 9,956,681 | B2 * | 5/2018 | Kao | B25H 3/06 |
| 2003/0019775 | A1 * | 1/2003 | Ernst | B25H 3/003 206/378 |
| 2011/0089126 | A1 * | 4/2011 | Hsieh | B25H 3/003 211/70.6 |
| 2016/0221178 | A1 * | 8/2016 | Hsieh | B25H 3/04 |

* cited by examiner

ANTI-THEFT RACK FOR SOCKET TOOLS

BACKGROUND OF THE INVENTION

1. Field of the Invention

The present invention relates to a rack for socket tools and, particularly, to a rack adapted to support and to releasably lock socket tools in place. More particularly, the tool rack has an anti-theft function.

2. Description of the Related Art

TW Pat. No. 1572466 discloses a rack adapted to support a tool. The rack includes a retaining device mounted thereon and configured to hold and prevent the tool from being removed from the rack. The retaining device includes a connecting portion slidably engaged with the rack and an engaging portion insertably engaged with the tool. The engaging portion is bifurcated into two resilient and flexible branches. The connecting portion extends from one of the branches. The engaging portion includes a strut interconnecting the connecting portion and the other of the branches. The strut is disposable. When the tool is retained, the strut interconnects the connecting portion and the other of the branches and the branches tightly abut against the tool. When the tool is not retained and adapted to disengage from the retaining device, the strut is cut off to allow the branches to be forced toward each other to disengage from the tool. After the strut is cut off, the retaining device can't be reused to retain the tool.

The present invention is, therefore, intended to obviate or at least alleviate the problems encountered in the prior art.

SUMMARY OF THE INVENTION

According to the present invention, an anti-theft rack for socket tools includes a rack frame supporting at least one retaining device. The at least one retaining device is configured to retain a socket tool and includes a seat mounted on the rack frame, a sliding member slidably engaged with the seat, and a retaining member disposed between the seat and the sliding member. The seat includes a shaft portion and the sliding member is movably mounted on the shaft portion. The shaft portion includes a recess including a first recessed portion and a second recessed portion adapted to receive the retaining member. The second recessed portion has a greater depth than the first recessed portion. The sliding member is movable with respect to the seat between a first position in which the retaining member is disposed in the first recessed portion and a second position in which the retaining member is disposed in the second recessed portion. Further, a position limiter is releasably disposed between two terminal positions of a moving path of the sliding member and configured to prevent the sliding member from the first position to the second position.

There has thus been outlined, rather broadly, the more important features of the invention so that the detailed description thereof that follows may be better understood, and so that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a rack adapted to support and to releasably lock socket tools in place.

Other objectives, advantages, and new features of the present invention will become apparent from the following detailed description of the invention when considered in conjunction with the accompanied drawings.

DETAILED DESCRIPTION OF THE INVENTION

Figure 1:
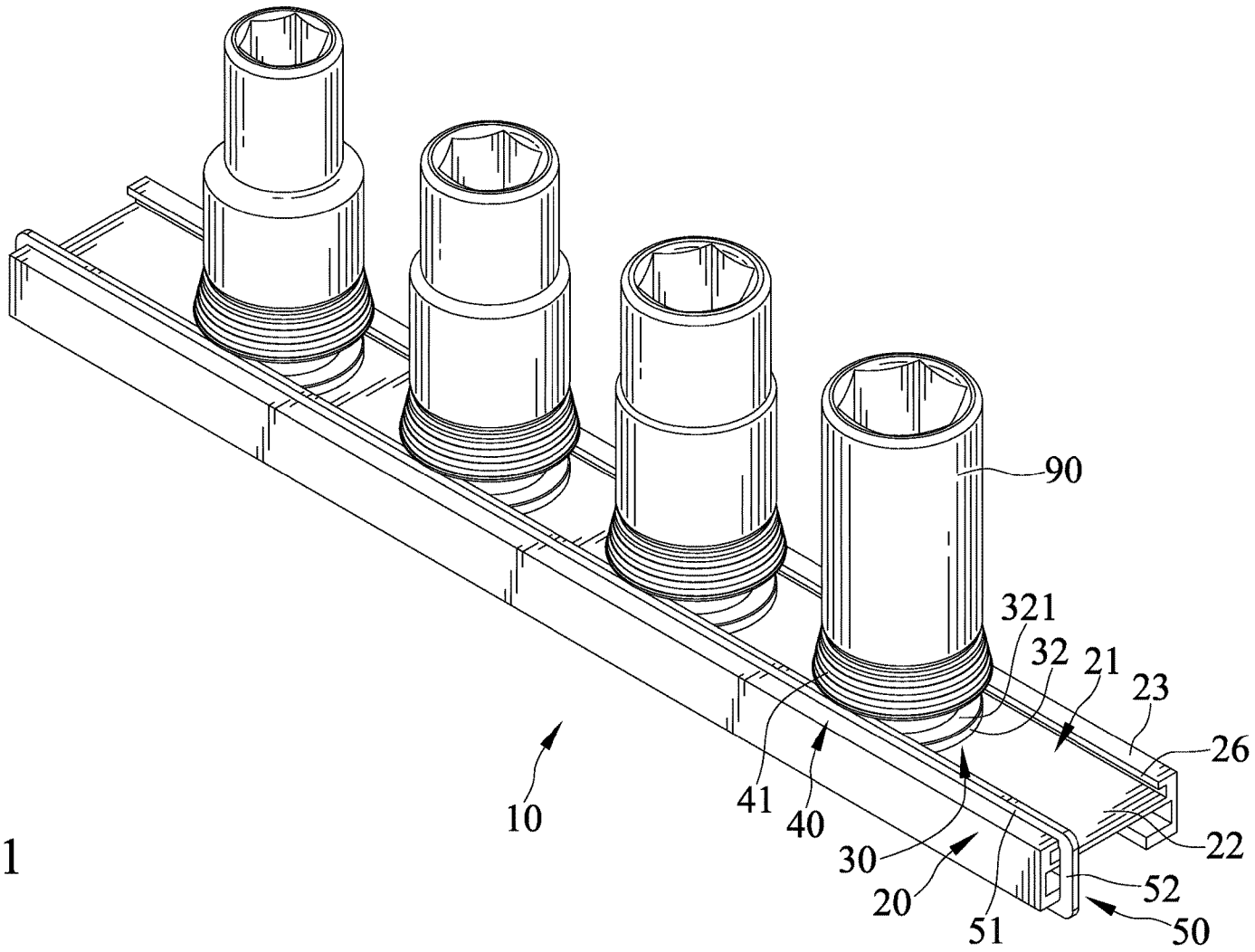
FIG. 1 is a perspective view showing an anti-theft rack in accordance with a first embodiment of the present invention supporting socket tools.
Figure 2:
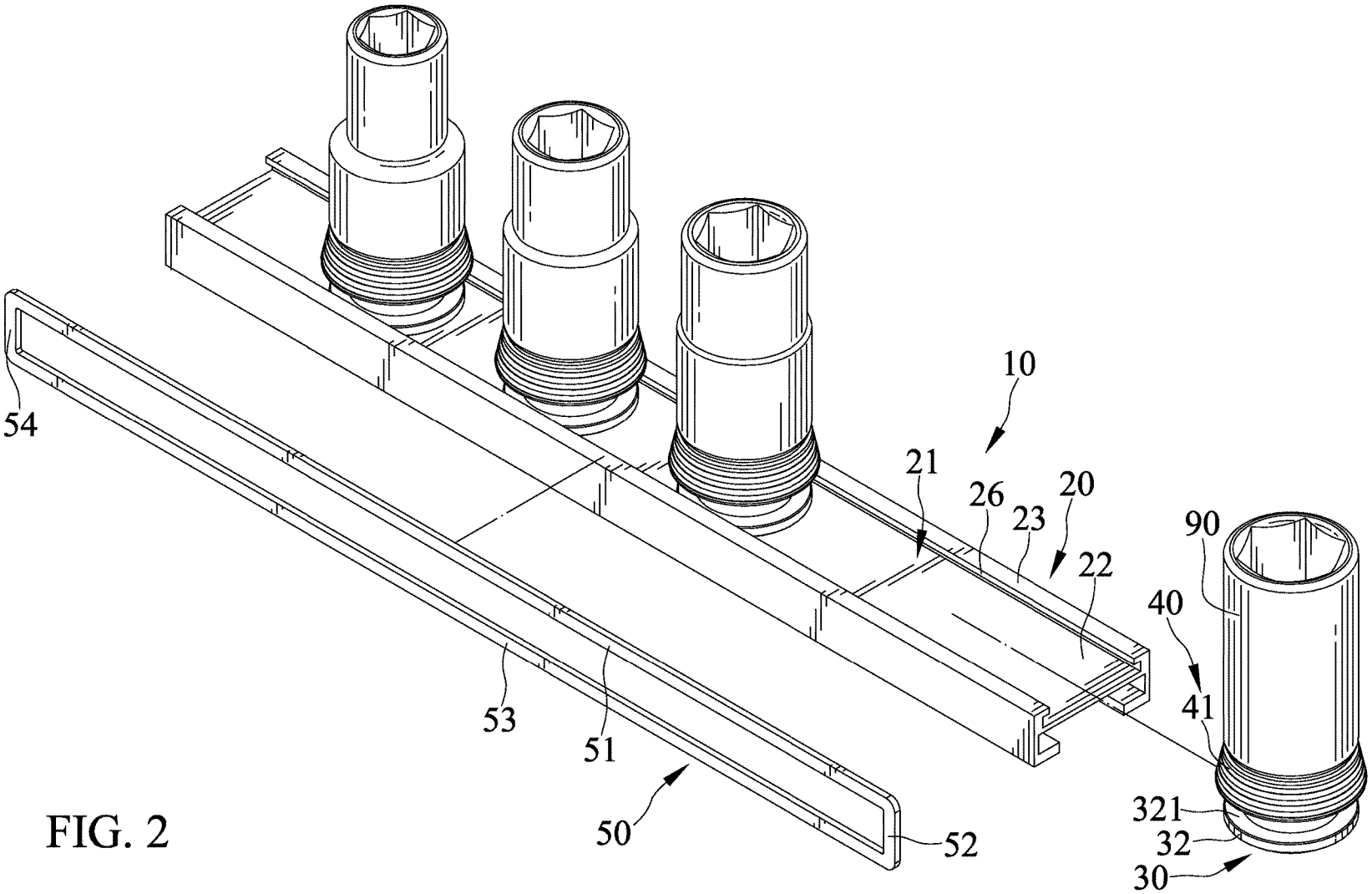
FIG. 2 is an exploded perspective view showing the anti-theft rack including a retaining device configured to engage with a socket.
Figure 3:
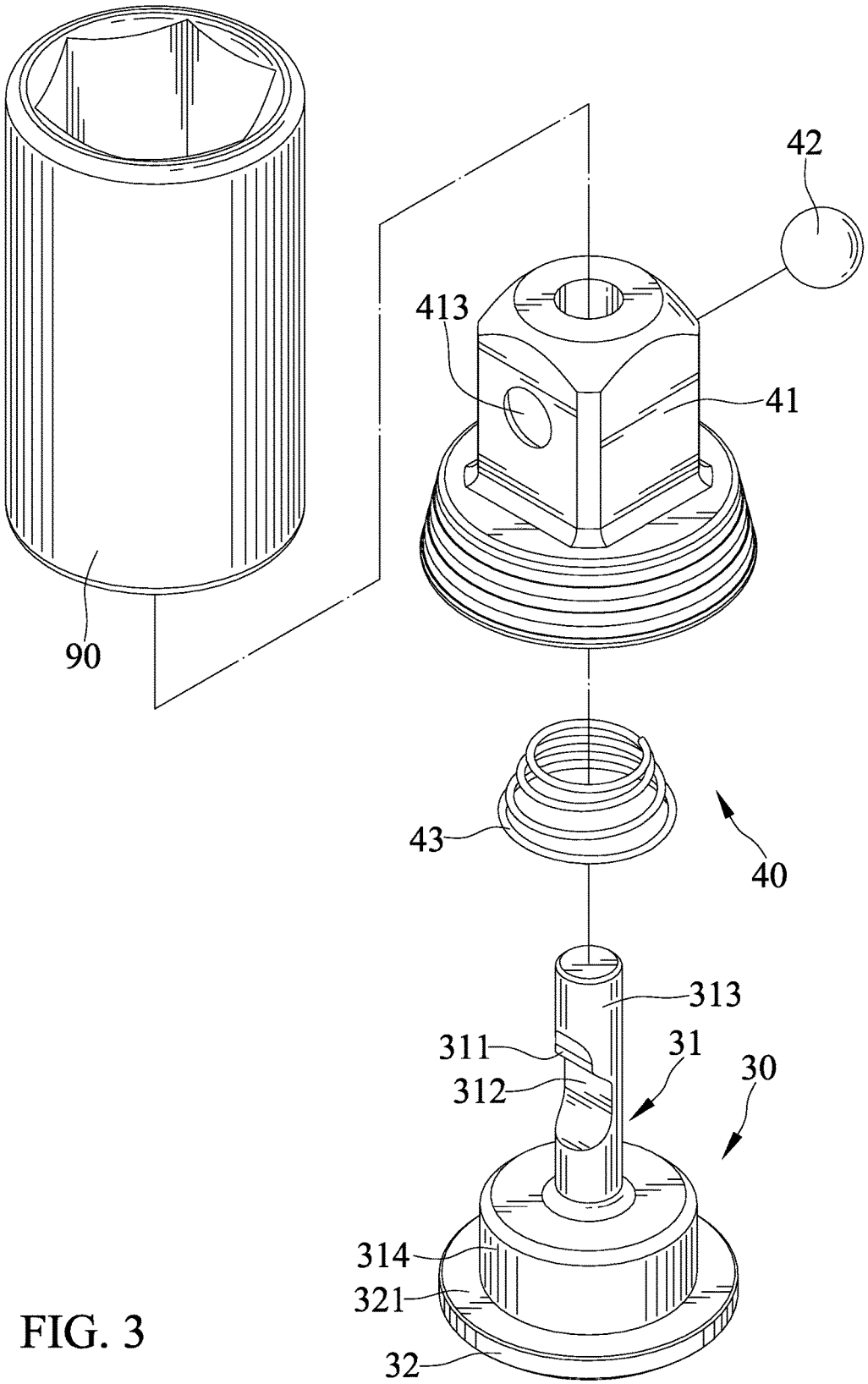
FIG. 3 is an exploded perspective view of the retaining device.

FIGS. 1-6 show an anti-theft rack 10 for socket tools 90 includes a rack frame 20 supporting at least one retaining device. The at least one retaining device is mounted on the rack frame 20 and configured to retain a socket tool 90.

The retaining device includes a seat 30 mounted on the rack frame 20, a sliding member 41 slidably engaged with the seat 30, and a retaining member 42 disposed between the seat 30 and the sliding member 41. The seat 30 is slidably mounted on the rack frame 20. The rack frame 20 defines a groove 21 receiving the seat 30. The groove 21 has a bottom surface 22, an open end opposing the bottom surface 22, and lateral sides. The rack frame 20 includes a ridge 23 extending radially from the lateral sides of the groove 21 such that the groove 21 includes a wide section 24 surrounded by the lateral sides and a narrow section 25 surrounded by the ridge 23. The ridge 23 in cross section includes two opposite lateral surfaces 26 spaced from each other. The seat 30 is engaged with a quick release device 40. The quick release device 40 includes the sliding member 41. The seat 30 includes a shaft portion 31 and the sliding member 41 is movably mounted on the shaft portion 31. The shaft portion 31 includes a recess including a first recessed portion 311 and a second recessed portion 312 adapted to receive the retaining member 42. The second recessed portion 312 has a greater depth than the first recessed portion 311. The seat 30 includes a base portion 32 engaged with the rack frame 20. The base portion 32 is disposed in the wide section 24 of the groove 21 and the first stop surface 321 is blocked by a bottom surface of the ridge 23. The sliding member 41 includes a hole 412 extending therein longitudinally and the seat 30 is inserted in the hole 412. The hole 412 has a first section 414 and a second section 415 extending from the first section 414 longitudinally and the second section 415 has a larger diametrical size than the first section 414. The shaft portion 31 of the seat 30 has a first length section 313 and a second length section 314 extending from the first length section 313 longitudinally and the second length section 314 has a larger diametrical size than the first length section 313. The recess is formed on the first length section 313. The first and second length sections 313 and 314 are respectively disposed in the first and second sections of the hole 414 and 415. The sliding member 41 is movable with respect to the seat 30 between a first position in which the retaining member 42 is disposed in the first recessed portion 311 and a second position in which the retaining member 42 is disposed in the second recessed portion 312. The retaining member 42 is selectively disposed between the first and second recessed portions 311 and 312 in response to movement of the sliding member 41 with respect to the seat 30. Moreover, the sliding member 41 is urged by a biasing member 43. The biasing member 43 is disposed between the sliding member 41 and the seat 30. The biasing member 43 includes a first end and a second end respectively abutting against the sliding member 41 and the seat 30. The sliding member 41 compresses the biasing member 43 during movement from the first position to the second position. The biasing member 43 is disposed in the second section of the hole 415.

Further, a position limiter 50 is releasably disposed between two terminal positions of a moving path of the sliding member 41 and configured to prevent the sliding member 41 from sliding from the first position to the second position. The position limiter 50 includes a limiting portion 51 located between the base portion 32 and the sliding member 41. The base portion 32 and the sliding member 41 respectively include a first stop surface 321 and a second stop surface 411. The limiting portion 51 has a first end disposed on the first stop surface 321 and a second end located between the two terminal positions of the moving path of the sliding member 41. The limiting portion 51 has a thickness T measured between the first and second ends thereof. The sliding member 41 in the second position is disposed in a spaced relationship from the first stop surface 321 at a distance D which is smaller than the thickness T. The position limiter 50 is engaged with the rack frame 20 and the seat 30. The position limiter 50 has an annular shape which includes a first extension disposed on the first stop surface 321, a second extension opposing the first extension and disposed on the rack frame 20, and third and fourth extensions opposing from each other and extending from the first extension to the second extension. The first extension forms the limiting portion 51. The second, third, and fourth extensions respectively form first, second, and third engaging portions 53, 52, and 54 engaging with the rack frame 20. The first and third extensions of the position limiter 50 extend along a longitudinal length of the rack frame 20.

Figure 4:
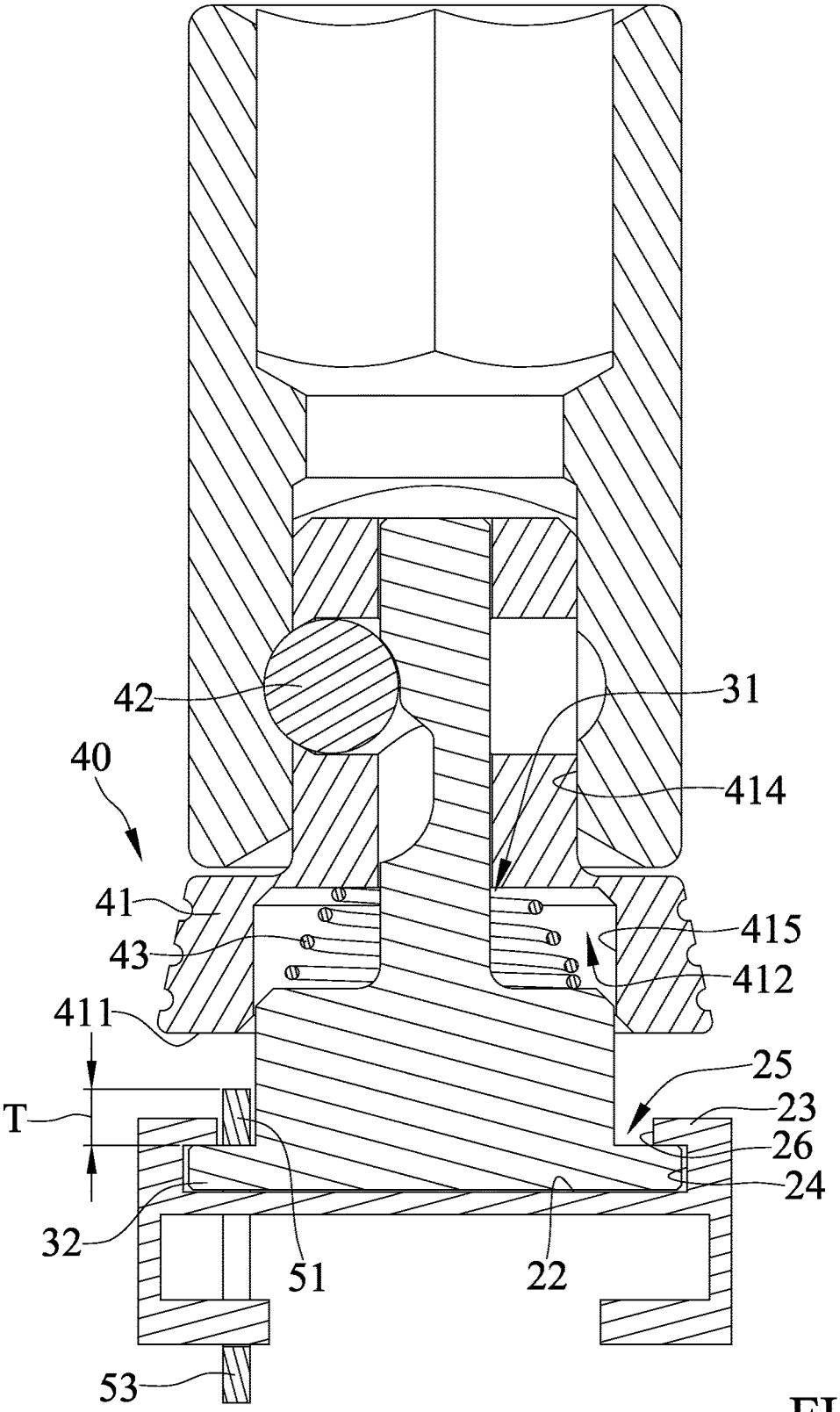
FIG. 4 is a cross-sectional view showing the retaining device retaining the socket tool and the anti-theft rack including a position limiter, which is configured to prevent the retaining device from allowing the socket tool to be disengaged therefrom.
Figure 5:
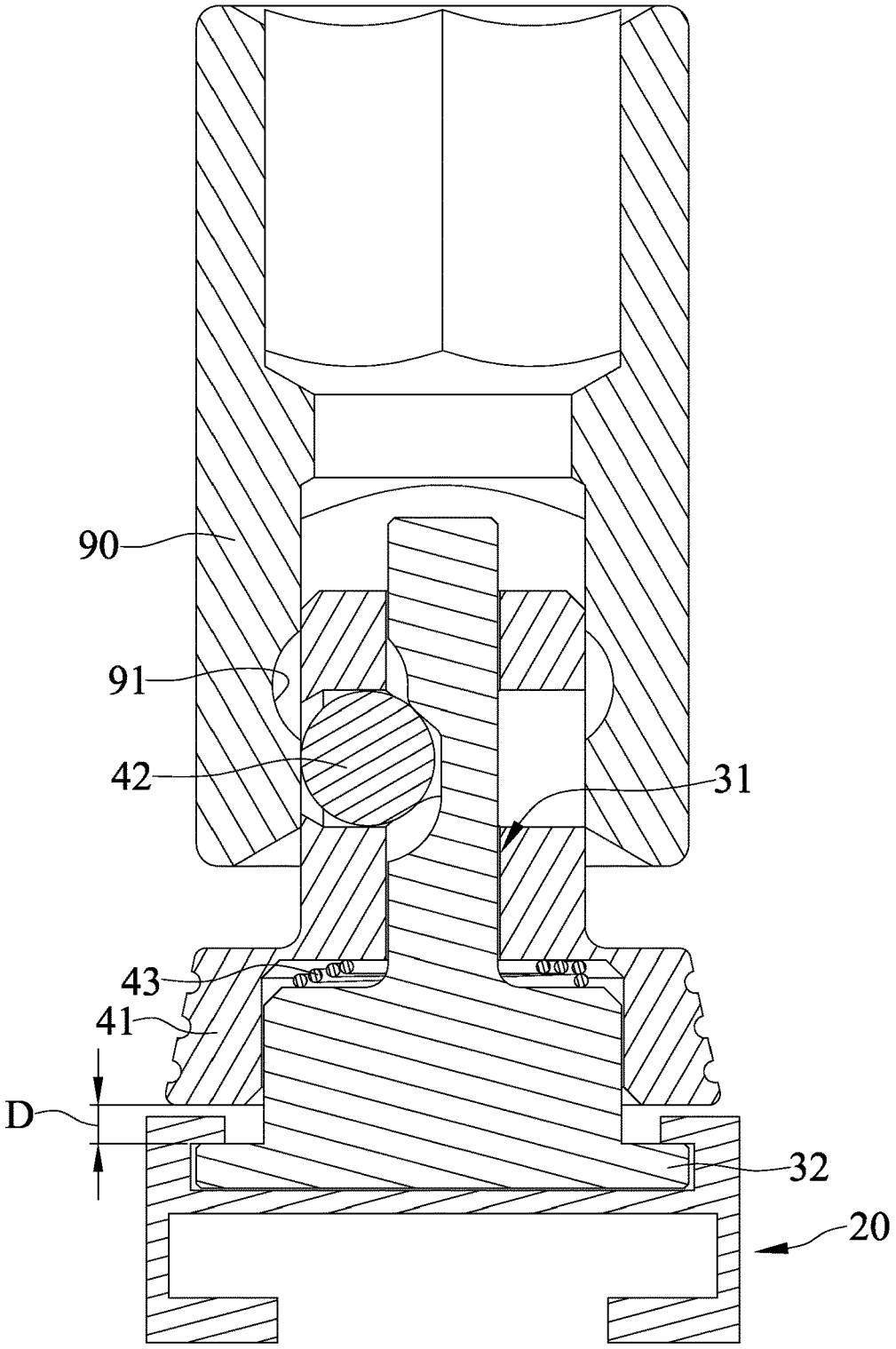
FIG. 5 is a cross-sectional view showing the position limiter disengaged from the rack and the retaining device released not retaining the socket tool.

FIG. 4 shows that when the socket tool 90 is retained on the retaining device, the socket tool 90 is coupled to the sliding member 41 and in frictional engagement with the retaining member 42. The socket tool 90 defines a hole and the sliding member 41 includes a connecting portion insertably engaged with the hole. The socket tool 90 defines a recess 91 on the periphery of the hole and the retaining member 42 is disposed in the recess 91. The retaining member 42 is in tight abutment with the recess 91 of the socket tool 90 and the first recessed portion 311. The sliding member 41 defines an aperture 413 and the retaining member 42 is movably received in the aperture 413. The aperture 413 extends radially through the sliding member 41. When the socket tool 90 is retained on the at least one retaining device, the retaining member 42 protrudes out of the hole of the sliding member 41.

When the position limiter 50 is disengaged from the rack frame 20 and the seat 30, the sliding member 41 can be moved to the second position to allow the socket tool 90 to disengage from the sliding member 41.

Figure 6:
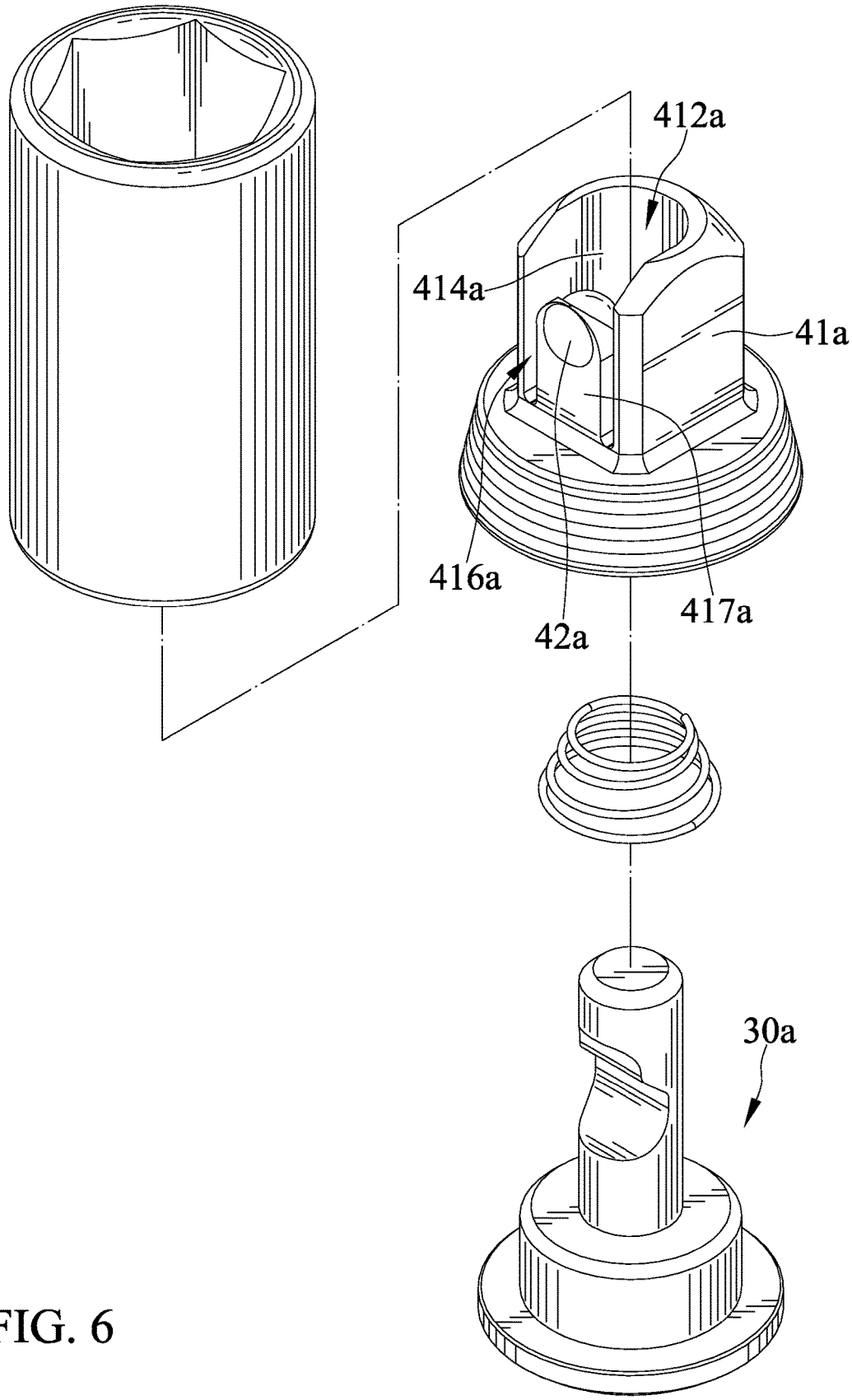
FIG. 6 is an exploded perspective view of an alternative retaining device.
Figure 7:
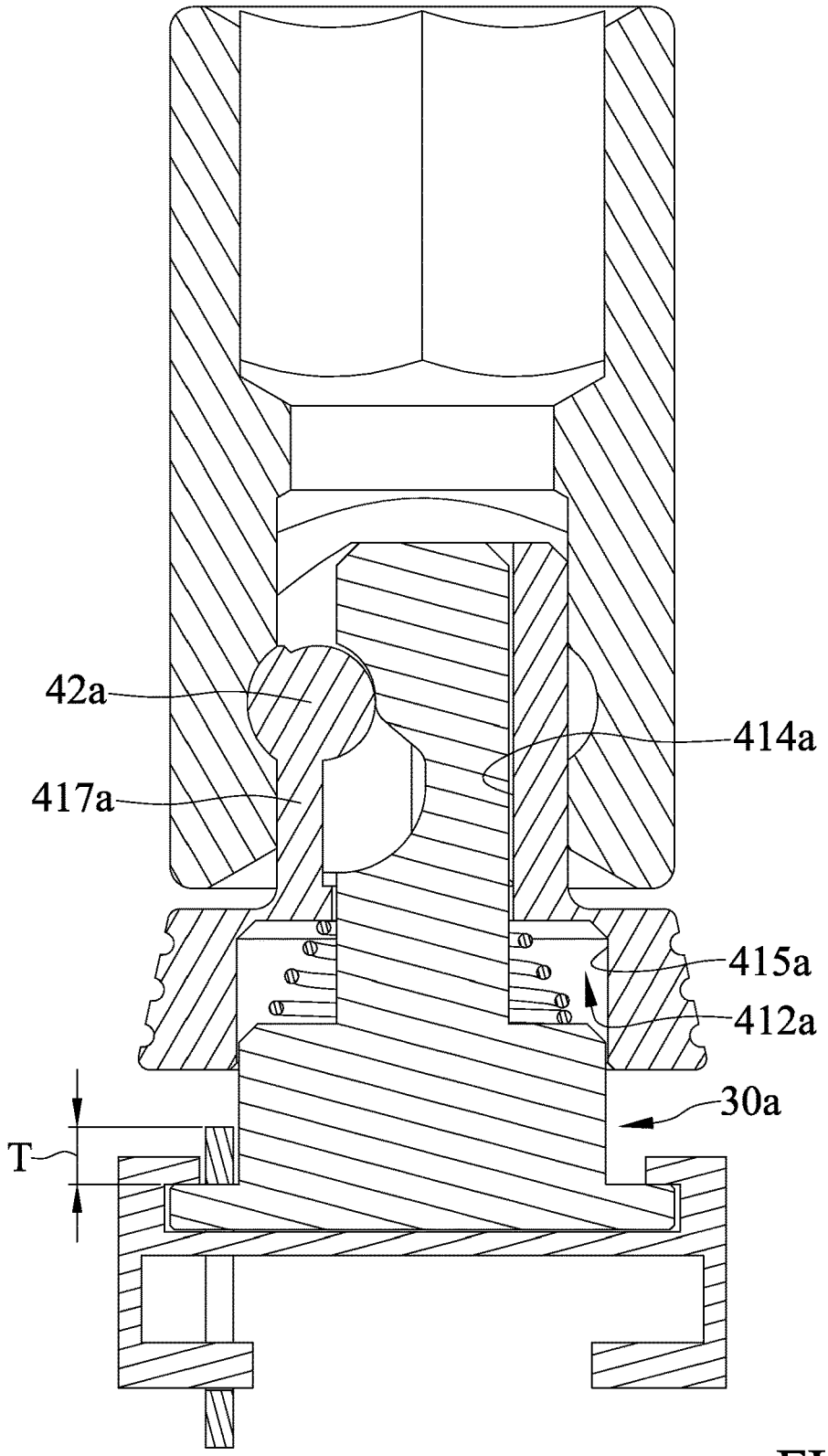
FIG. 7 a cross-sectional view showing the alternative retaining device retaining the socket tool and the position limiter.
Figure 8:
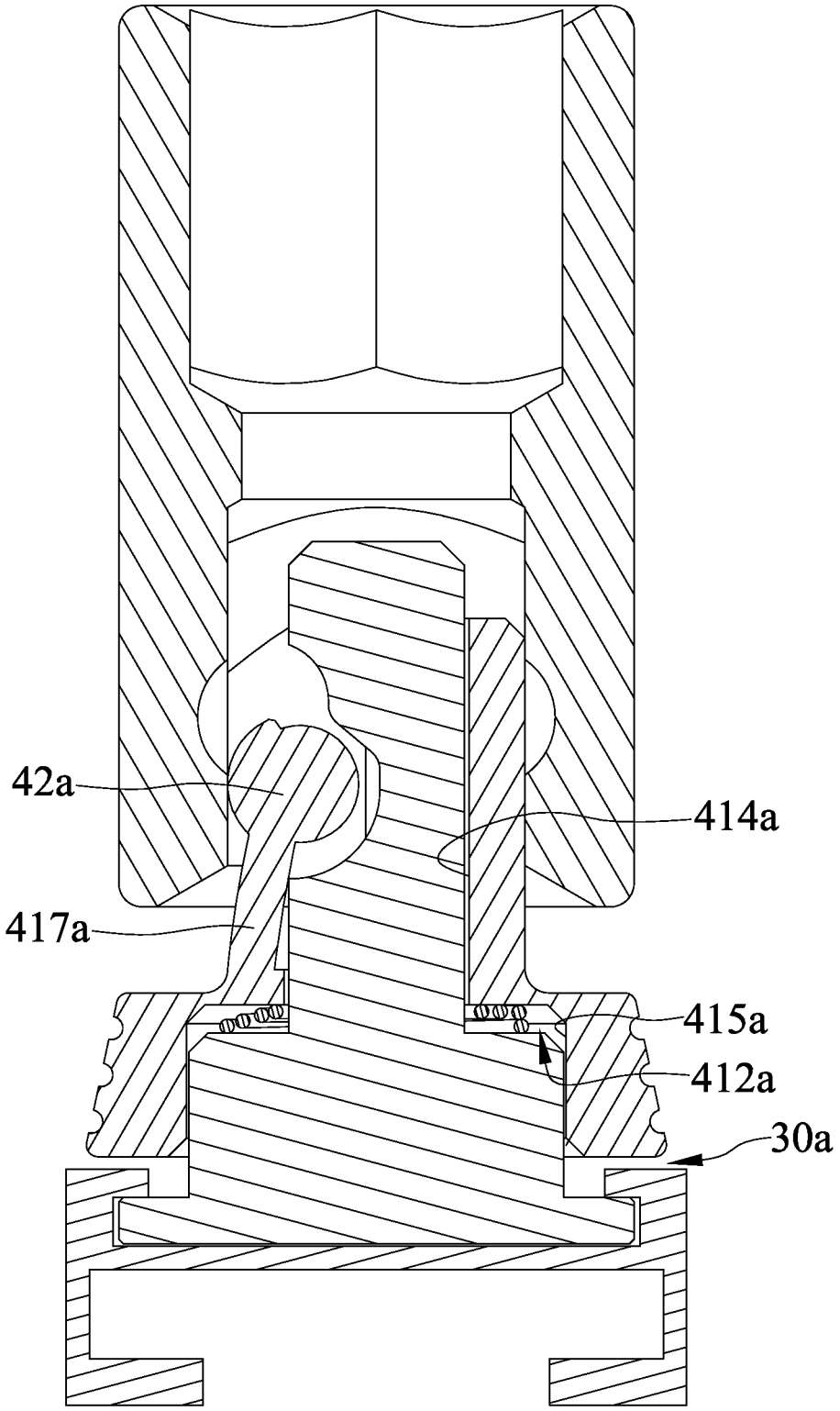
FIG. 8 is a cross-sectional view showing the position limiter disengaged from the rack and the retaining device not retaining the socket tool.

The retaining device shown in FIGS. 6-8 includes a seat 30*a*, a sliding member 41*a* slidably engaged with the seat 30*a*, and a retaining member 42*a* disposed between the seat 30*a* and the sliding member 41*a*. A biasing member is also adapted disposed between the sliding member 41*a* and the seat 30*a*. The seat 30*a* is the similar to the seat 30. The sliding member 41*a* includes a hole extending therein and the seat 30*a* is inserted in the hole 412*a*. The hole 412*a* has a first section 414*a* and a second section 415*a* extending from the first section 414*a* longitudinally. The second section 415*a* has a larger diametrical size than the first section 414*a*. The sliding member 41*a* is similar to the sliding member 41 except that the sliding member 41*a* and the retaining member 42*a* are made from the same material and is a one-piece structure. The retaining member 42*a* is a projection 417*a* which has a fixed distal end and a free distal end and lateral sides spaced from a connecting portion of the sliding member 41*a* with a gap 416*a*. The retaining member 42*a* is flexible.

In view of the forgoing, the position limiter 50 is releasably disposed between two terminal positions of the moving path of the sliding member 41 and 41*a* and configured to prevent the sliding member 41 and 41*a* from the first position to the second position, thereby providing an anti-theft effect.

The foregoing is merely illustrative of the principles of this invention, and various modifications can be made by those skilled in the art without departing from the scope and spirit of the invention.

What is claimed is:

1. An anti-theft rack for socket tools comprising:

a rack frame;

at least one retaining device mounted on the rack frame and configured to retain a socket tool, wherein the retaining device includes a seat mounted on the rack frame, a sliding member slidably engaged with the seat, and a retaining member disposed between the seat and the sliding member, wherein the seat includes a shaft portion and the sliding member is movably mounted on the shaft portion, wherein the shaft portion includes a recess including a first recessed portion and a second recessed portion adapted to receive the retaining member, wherein the second recessed portion has a greater depth than the first recessed portion, wherein the sliding member is movable with respect to the seat between a first position in which the retaining member is disposed in the first recessed portion and a second position in which the retaining member is disposed in the second recessed portion; and a position limiter releasably disposed between two terminal positions of a moving path of the sliding member and configured to prevent the sliding member from sliding from the first position to the second position.

2. The anti-theft rack as claimed in claim 1, wherein the seat includes a base portion engaged with the rack frame, wherein the position limiter includes a limiting portion located between the base portion and the sliding member, wherein the base portion and the sliding member respectively include a first stop surface and a second stop surface and the limiting portion has a first end disposed on the first stop surface and a second end located between the two terminal positions of the moving path of the sliding member, wherein the limiting portion has a thickness measured between the first and second ends thereof, and wherein the sliding member in the second position is disposed in a spaced relationship from the first stop surface at a distance which is smaller than the thickness.

3. The anti-theft rack as claimed in claim 2, wherein the position limiter is engaged with the rack frame and the seat, wherein the position limiter has an annular shape which includes a first extension disposed on the first stop surface, a second extension opposing the first extension and disposed on the rack frame, and third and fourth extensions opposing from each other and extending from the first extension to the second extension, wherein the first extension forms the limiting portion, wherein the second, third, and fourth extensions respectively form first, second, and third engaging portions engaging with the rack frame, and wherein the first and second extensions of the position limiter extend along a longitudinal length of the rack frame.

4. The anti-theft rack as claimed in claim 1 further comprising a biasing member disposed between the sliding member and the seat such that the sliding member is urged by the biasing member.

5. The anti-theft rack as claimed in claim 2 further comprising a biasing member disposed between the sliding member and the seat such that the sliding member is urged by the biasing member.

6. The anti-theft rack as claimed in claim 3 further comprising a biasing member disposed between the sliding member and the seat such that the sliding member is urged by the biasing member.

7. The anti-theft rack as claimed in claim 4, wherein the sliding member includes a hole extending therein longitudinally and the seat is inserted in the hole, wherein the hole has a first section and a second section extending from the first section longitudinally and the second section has a larger diametrical size than the first section, wherein the shaft portion of the seat has a first length section and a second length section extending from the first length section longitudinally and the second length section has a larger diametrical size than the first length section, wherein the first and second length sections of the seat are respectively disposed in the first and second sections of the hole, wherein the recess is formed on the first length section, and wherein the biasing member is disposed in the second section of the hole.

8. The anti-theft rack as claimed in claim 5, wherein the sliding member includes a hole extending therein longitudinally and the seat is inserted in the hole, wherein the hole has a first section and a second section extending from the first section longitudinally and the second section has a larger diametrical size than the first section, wherein the shaft portion of the seat has a first length section and a second length section extending from the first length section longitudinally and the second length section has a larger diametrical size than the first length section, wherein the first and second length sections of the seat are respectively disposed in the first and second sections of the hole, wherein the recess is formed on the first length section, and wherein the biasing member is disposed in the second section of the hole.

9. The anti-theft rack as claimed in claim 6, wherein the sliding member includes a hole extending therein longitudinally and the seat is inserted in the hole, wherein the hole has a first section and a second section extending from the first section longitudinally and the second section has a larger diametrical size than the first section, wherein the shaft portion of the seat has a first length section and a second length section extending from the first length longitudinally and the second length section has a larger diametrical size than the first length section, wherein the first and second length sections of the seat are respectively disposed in the first and second sections of the hole, wherein the recess is formed on the first length section, and wherein the biasing member is disposed in the second section of the hole.

10. The anti-theft rack as claimed in claim 2, wherein the rack frame defines a groove receiving the seat, wherein the groove has a bottom surface, an open end opposing, the bottom surface, and lateral sides, wherein the rack frame includes a ridge extending radially from the lateral sides of the groove such that the groove includes a wide section surrounded by the lateral sides and a narrow section surrounded by the ridge, wherein the ridge in cross section includes two opposite lateral surfaces spaced from each other, wherein the base portion is disposed in the wide section of the groove and the first stop surface is blocked by a bottom surface of the ridge.

11. The anti-theft rack as claimed in claim 9, wherein the rack frame defines a groove receiving the seat, wherein the groove has a bottom surface, an open end opposing the bottom surface, and lateral sides, wherein the rack frame includes a ridge extending radially from the lateral sides of the groove such that the groove includes a wide section surrounded by the lateral sides and a narrow section surrounded by the ridge, wherein the ridge in cross section includes two opposite lateral surfaces spaced from each other, wherein the base portion is disposed in the wide section of the groove and the first stop surface is blocked by a bottom surface of the ridge.

12. The anti-theft rack as claimed in claim 1, wherein the seat is slidably mounted on the rack frame.

13. The anti-theft rack as claimed in claim 10, wherein the seat is slidably mounted on the rack frame.

14. The anti-theft rack as claimed in claim 11, wherein the seat is slidably mounted on the rack frame.

15. The anti-theft rack as claimed in claim 1, wherein the sliding member defines an aperture and the retaining member is movably received in the aperture, wherein the aperture extends radially through the sliding member, and wherein when the sliding member is in the first position, the retaining member protrudes out of the hole of the sliding member.

16. The anti-theft rack as claimed in claim 11, wherein the sliding member defines an aperture and the retaining member is movably received in the aperture, wherein the aperture extends radially through the sliding member, and wherein when the sliding member is in the first position, the retaining member protrudes out of the hole of the sliding member.

17. The anti-theft rack as claimed in claim 1, wherein the sliding member and the retaining member are made from the same material and is a one-piece structure, wherein the retaining member is a projection which has a fixed distal end and a free distal end and lateral sides spaced from a connecting portion of the sliding member with a gap, and wherein the retaining member is flexible.

18. The anti-theft rack as claimed in claim 11, wherein the sliding member and the retaining member are made from the same material and is a one-piece structure, wherein the retaining member is a projection which has a fixed distal end and a free distal end and lateral sides spaced from a connecting portion of the sliding member with a gap, and wherein the retaining member is flexible.

* * * * *